United States Patent [19]

Ohm

[11] 4,167,715

[45] Sep. 11, 1979

[54] WIDEBAND POLARIZATION COUPLER

[75] Inventor: Edward A. Ohm, Holmdel, N.J.

[73] Assignee: Bell Telephone Laboratories, Incorporated, Murray Hill, N.J.

[21] Appl. No.: 918,078

[22] Filed: Jun. 22, 1978

[51] Int. Cl.[2] ..... H01P 1/16; H01P 5/12

[52] U.S. Cl. ..... 333/125; 333/21 A; 333/251

[58] Field of Search ..... 333/21 R, 21 A, 125, 333/126, 135, 137

[56] References Cited

U.S. PATENT DOCUMENTS

| | | | |
|---|---|---|---|
| 2,961,618 | 11/1960 | Ohm | 333/9 |
| 2,975,380 | 3/1961 | Scharfman | 333/9 |
| 3,162,828 | 12/1964 | Schmidt et al. | 333/21 R X |
| 3,327,250 | 6/1967 | Sleeper, Jr. | 333/21 |
| 3,369,197 | 2/1968 | Giger et al. | 333/21 |
| 4,047,128 | 9/1977 | Morz | 333/21 R X |

FOREIGN PATENT DOCUMENTS

| | | | |
|---|---|---|---|
| 767518 | 2/1957 | United Kingdom | 333/9 |

*Primary Examiner*—Paul L. Gensler
*Attorney, Agent, or Firm*—Erwin W. Pfeifle

[57] ABSTRACT

The present invention provides a polarization coupler which is capable of coupling or separating dual linear polarized microwave signals having frequencies which extend over extremely wide frequency bands. The present polarization coupler (11) comprises a main waveguide (12) and a side-arm waveguide (13) with a plurality of septa (16) arranged at the junction to reflect energy of a first polarization ($E_1$) between the main and side-arm waveguide while energy of a second polarization ($E_2$) passes the junction unaffected. The side-arm waveguide includes an odd plurality of triangular-shaped plates (14) each with a separate spaced-apart chevron-shaped plate (20) extending therefrom and arranged to reflect electromagnetic energy in a separate first and second frequency band, respectively, of the second polarization back to the junction, a single septum (22) disposed in alignment with the central one of the triangular-shaped and chevron-shaped plates, and a pair of parallel spaced-apart irises (17, 18) at the junction.

8 Claims, 4 Drawing Figures

WIDEBAND POLARIZATION COUPLER

BACKGROUND OF THE INVENTION

1. Field of the Invention

The present invention relates to wideband microwave polarization couplers and, more particularly, to polarization couplers which provide coupling for dual linear polarized signals having frequencies which extend over extremely wide frequency bands.

2. Description of the Prior Art

It is well known that the information capacity of a given guided wave microwave transmission system can be increased by utilizing the two dominant cross polarized modes of the main guide of the system to propagate two different waves at a common frequency. In any such dual mode system it is often necessary to selectively couple the mode of one polarization to and from the main guide to the exclusion of the other mode of polarization. Polarization couplers for performing this selective coupling function are known in the art. Typically, such couplers comprise a main guide, a side-arm guide joined to the main guide, and a discontinuity disposed within the main guide such that the excluded mode is transmitted through the main guide and the coupled mode is diverted into the side-arm guide. Generally speaking, these prior art couplers have performed satisfactorily only over single frequency bands such as, for example, the 4 GHz common carrier band for the coupled mode. None of these couplers, therefore, are capable of "ultrawideband" operation for the coupled mode. The term "ultrawideband" is used herein to mean a frequency band for which the ratio of the highest to the lowest frequency contained therein is at least 1.74. Thus, e.g., a band extending through the 4 GHz and the 6 GHz common carrier bands would be such an ultrawideband.

A polarization coupler is disclosed in U.S. Pat. No. 2,961,618 granted on Nov. 22, 1960 to the applicant hereof and assigned to the assignee hereof wherein the bandwidth of the excluded mode of polarization can be extended over an ultrawideband of frequencies (i.e., from 3.7 GHz to 11.7 GHz).

For other patents which disclose arrangements for increasing the bandwidth of the coupled mode of polarization coupler see, for example, U.S. Pat. Nos. 2,975,380 issued to H. Scharfman on Mar. 14, 1961, and 3,327,250 issued to G. B. Sleeper, Jr. on June 20, 1967. In the Sleeper, Jr. patent such a result is realized by disposing two septa, which are offset from each other, at the junction of the main guide and side-arm guide of the coupler. In the Scharfman patent, on the other hand, a plurality of posts or rods are positioned at the junction to obtain the increased bandwidth. The arrangements of the latter two patents, however, still provide a coupled mode which is limited in bandwidth but provides improvement over the prior art polarization couplers.

The problem remaining in the prior art is to provide a polarization coupler for which the coupled mode of polarization can have an ultrawide frequency band.

BRIEF SUMMARY OF THE INVENTION

The foregoing problem has been solved in accordance with the present invention which relates to a wideband polarization coupler and, more particularly, to a polarization coupler for which the coupled mode of polarization can have an ultrawide frequency band.

It is an aspect of the present invention to provide a wideband polarization coupler comprising a main waveguide and a side-arm waveguide joined to the main waveguide. At the junction of the two waveguides, the main waveguide includes a plurality of rectangular-shaped septa arranged to reflect electromagnetic energy in a first polarization direction propagating in the main waveguide into the side-arm waveguide while permitting electromagnetic energy in a second orthogonal polarization direction to pass the junction unaffected. The side-arm waveguide includes an odd plurality of triangular-shaped plates each with a separate spaced-apart chevron-shaped plate extending therefrom and arranged to reflect electromagnetic energy in a separate first and second frequency band, respectively, of the second polarization back to the junction, a single septum disposed in alignment with the central one of the triangular-shaped and chevron-shaped plates, and a pair of parallel spaced-apart irises at the junction.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
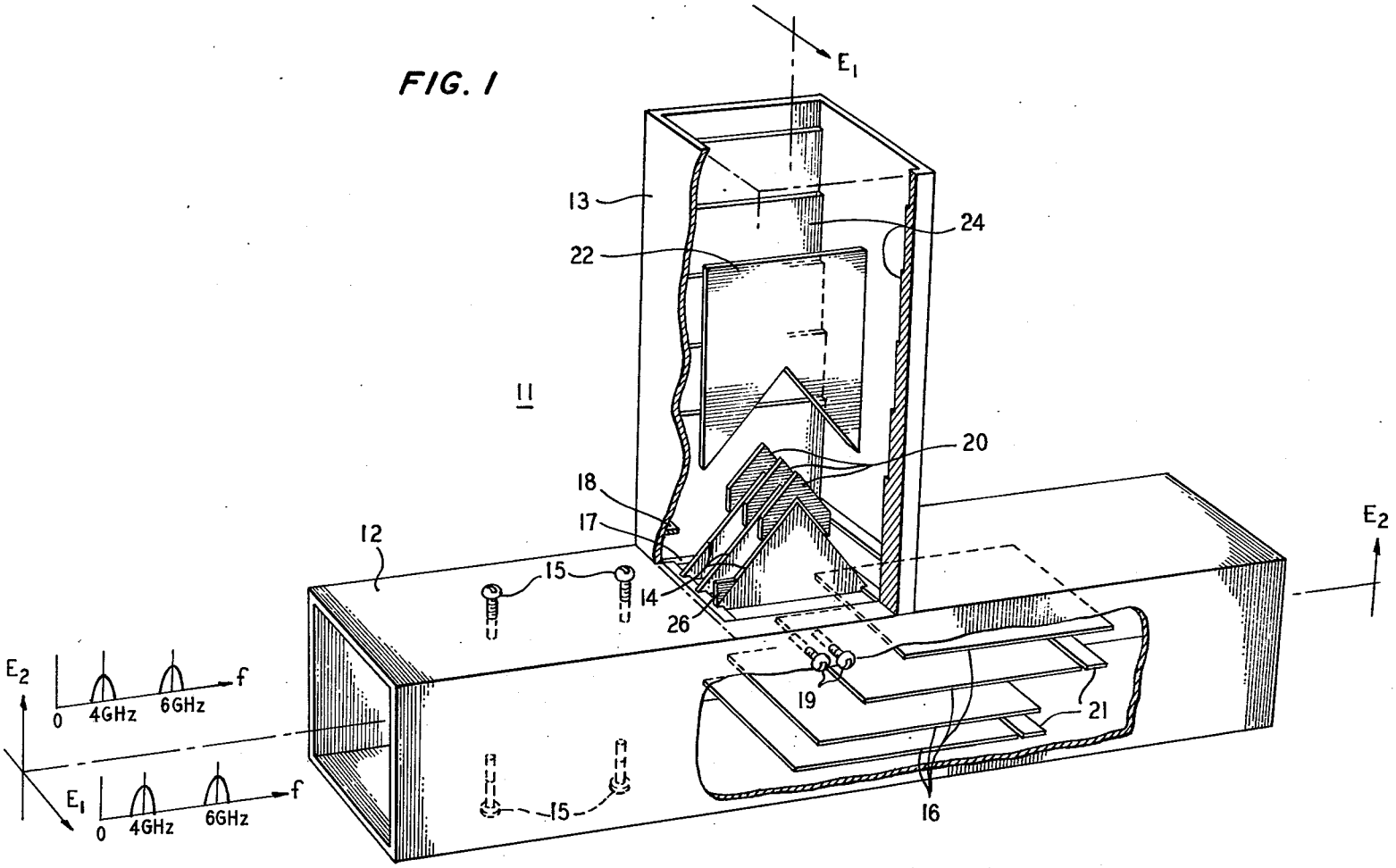
FIG. 1 is a view in perspective of a wideband polarization coupler in accordance with the present invention.

FIG. 1 illustrates a polarization coupler 11 in accordance with the principles of the present invention which comprises a conductively bounded waveguide 12 (i.e., a main guide) which is capable of supporting orthogonal polarizations of microwave energy. Guide 12 is of square cross section having a side dimension such that the orthogonally polarized $TE_{01}$ and $TE_{10}$ dominant modes at the lowest frequency to be transmitted can be supported. The two orthogonal polarizations of interest to the present disclosure are represented schematically by the vectors $E_1$ and $E_2$. The vector $E_1$ depicts the electric field of one mode of polarization having its plane of polarization extending in the direction of this vector. The vector $E_2$, on the other hand, represents the electric field direction of a mode polarized at right angles to $E_1$.

In accordance with the present invention, each of the polarizations $E_1$ and $E_2$ has an ultrawide bandwidth which comprises frequencies for which guide 12 is a higher order mode guide. In particular, for the purposes of illustration only, it will hereinafter be assumed that each of these polarizations has an ultrawide bandwidth which includes both the 4 GHz and 6 GHz common carrier bands. Moreover, to simplify the presentation, it will be further assumed that the frequency components of each polarization, except for those in the two common carrier bands, are all zero. The frequency spectra of $E_1$ and $E_2$ are illustrated in FIG. 1 adjacent to their respective polarizations.

Guide 12 is joined by waveguide 13 (i.e., a side-arm guide) of rectangular cross-sectional dimensions such that the dominant $TE_{10}$ mode at the lowest frequency to be transmitted can be supported. The junction with guide 12 is made in a shunt of the magnetic plane junction for the $E_1$ polarization which is commonly referred to as an "H-plane bend." In the present illustrative embodiment, the narrower transverse dimension of guide 13 is parallel to the polarization $E_1$ in guide 12 and the longitudinal axis of guide 13 is perpendicular to the axis of guide 12. For the purposes of illustration, to support the exemplary 4–6 GHz bandwidth signals, the main waveguide 12 has a square cross section with a width of, for example, 1.810 inches which dimension is chosen to be as large as possible without supporting the $TE_{20}$ mode at the high end of the 6 GHz band. The side-arm waveguide 13 has, for example, the same width, 1.810 inches, and its smaller dimension at the junction aperture can be, for example, 1.145 inches, which dimension is chosen to equalize the matching problems for the straight-through and around-the-corner polarizations.

In order to provide transfer of both frequency component bands of the $E_2$ polarization past the junction of guides 12 and 13 without being adversely affected thereby, techniques analogous to those disclosed in my above-mentioned U.S. Pat. No. 2,961,618 are employed. Thus, as shown, an odd plurality of thin triangular-shaped plates, septa, or vanes 14 are disposed in the end of rectangular guide 13 adjacent to guide 12 in planes that are parallel to each other and to the wide dimension of guide 13. The lower ends of these vanes are aligned with the inside surface of guide 12 thus completing the conduction path for longitudinal wall currents and providing a conductive surface upon which substantially all the lines of electric field of the $E_2$ polarization may terminate. As a result, the reactive discontinuity introduced into the $E_2$ polarization by the junction is substantially eliminated. Since the frequency components in the exemplary 6 GHz band no longer see a discontinuity at the junction, no higher order modes are generated by these components. Thus, $E_2$ passes by the junction substantially unperturbed over both its frequency bands. Moreover, it should be noted that, since the plane of vanes 14 is always normal to the electric field of $E_1$, they have little effect on this polarization.

More particularly, the transverse currents at the top of the main waveguide 12 are interrupted by the sides of the aperture, and the resulting opposing E-fields generate two oppositely polarized waves which propagate upwards into the side-arm waveguide 13. As these waves emerge above the inclined edges of the triangular plates 14, the E-field components perpendicular to the center plate tend to cancel, resulting in partial reflections back toward the coupling aperture. In addition, the oppositely polarized waves are progressively converted into a stripline mode, where the stripline cross section is defined by a transverse cut of the side-arm waveguide 13 in the region of the triangular plates 14. The reduction in triangular plate 14 width corresponds to an increase in stripline impedance level, while the increase in impedance causes additional energy to be progressively reflected back toward the coupling aperture. As a result of the proper choice of triangular-plate height, all reflected components return to the aperture with a collective total phase shift which makes the aperture appear as a short circuit to polarization $E_2$. A unique feature of the triangular shape is the phase of the net reflection is controlled in such a way that the short circuit is well preserved across the exemplary 4 GHz band. Therefore, the triangular plates have a height which is optimized over the 4 GHz band. As a rule of thumb, the optimum height of the triangular plates is about 20 percent larger than $\lambda_0/4$ at 4 GHz, where $\lambda_0$ is the free space wavelength.

To realize a similar short circuit across the 6 GHz band, the effective height of the triangular plates 14 should, for example, be about $3\lambda_0/4$, which is achieved by adding chevron-shaped trimmer plates 20 above and in-line-with the triangular plates 14. The chevron plates 20 change the electrical height at 6 GHz because they are strongly coupled to the triangular plates 14 by an E-field between each triangular plate and its adjacent chevron plate. Conversely, at 4 GHz the height is unchanged because the coupling is essentially zero since the E-fields are parallel to the wide dimension of the side-arm waveguide 13 and, at 4 GHz, these E-fields are well beyond cutoff. As a result, at 4 GHz the oppositely-polarized waves are reflected near the top of the triangular plates 14 as if the chevron plates 20 were not there, whereas at 6 GHz, the waves are reflected near the top of the chevron plates 20. The combined height of the triangular plates 14 and the chevron-shaped plates 20 are optimized over the 6 GHz band. Experimental results have shown that the optimum height of the top of the chevron plates 20, with respect to the base of the triangular plates 14, is about 7 percent less than $3\lambda_0/4$.

However, even when the chevron plates 20 are proportioned for the best return loss at 6 GHz, a very small percentage of the straight-through 6 GHz power may possibly be converted to a wave which propagates into the side-arm waveguide 13. The E-field of this wave is in the nonstandard direction, i.e., parallel to the wide dimension of the side-arm waveguide 13, and accordingly, the wave is probably in the $TE_{01}$ mode. To prevent this loss, the wave is reflected back toward the main waveguide 12 by the single septum 22 shown in the side-arm waveguide 13. When properly phased by properly positioning the single septum 22, the reflected energy improves the apparent short ciruit at the coupling aperture, and thus improves the transmission of polarization $E_2$. This problem does not occur at 4 GHz because there all modes with polarizations parallel to the wide dimension of the side-arm waveguide 13 are well beyond cutoff.

Thus far, discussion has been principally confined to the transmission of the $E_2$ polarization through guide 12. Consider now the transmission of $E_1$ polarized at right angles to $E_2$. In order to minimize the interference and crosstalk between signals carried by these two modes, all the energy of the $E_1$ polarization must be diverted into guide 13 without any reflections. Moreover, it is important to note that this requirement must be accomplished without exciting higher order modes.

In accordance with the present invention, both component bands of $E_1$ are coupled into guide 13 without the generation of higher order modes or unwanted reflections by employing at the junction of guides 12 and 13 both a number of septa or thin, elongated plates 16 mounted within guide 12 with the leading edges thereof disposed in a staircase configuration to reflect energy of the $E_1$ polarization into guide 13, and a first iris 17 mounted at the junction. A second iris 18 is disposed in guide 13 near and parallel to first iris 17 and a separate pair of tuning screws 19 penetrate each of the sidewalls of guide 12 adjacent first iris 17. The first and second irises 17 and 18 each appear as an inductance to energy passing thereby while tuning screws 19 appear as a capacitance which in combination form a network to provide the desired coupling.

In the illustrative embodiment of FIG. 1, four septa 16 are employed. Three of the septa 16 equally divide guide 12 while the fourth septa equally divides the area between both the one of the three septa and the wall of guide 12 furthest from iris 17 to enhance the reflection of the $E_1$ polarization energy into side-arm guide 13. However, in accordance with the present invention, any number of septa 16 equal to or greater than four can be employed. As seen more clearly in the cross-sectional view of FIG. 2, first iris 17 may constitute an aperture in the wall of guide 12. Second iris 18 may be formed by separate plates fixed to the inner wall of guide 13.

Septa 16 on the other hand, are disposed in guide 12 in planes parallel to the cross-sectional dimensions of first iris 17 and, therefore, in the plane of polarization of $E_1$. The septa 16 are arranged such that they divide guide 12 into a plurality of sections each of which is beyond cutoff for the $E_1$ mode at the highest frequency to be transmitted. Moreover, the septa are disposed in a staircase-like configuration with successive septa partially overlapping each other. Typically, each septum can have a thickness of the order of 0.010 inches and a length of half a wavelength at the lowest frequency to be transmitted. Additionally, in a typical case, the overlap between successive septa can be greater than a quarter of a wavelength at the highest frequency to be transmitted.

Figure 2:
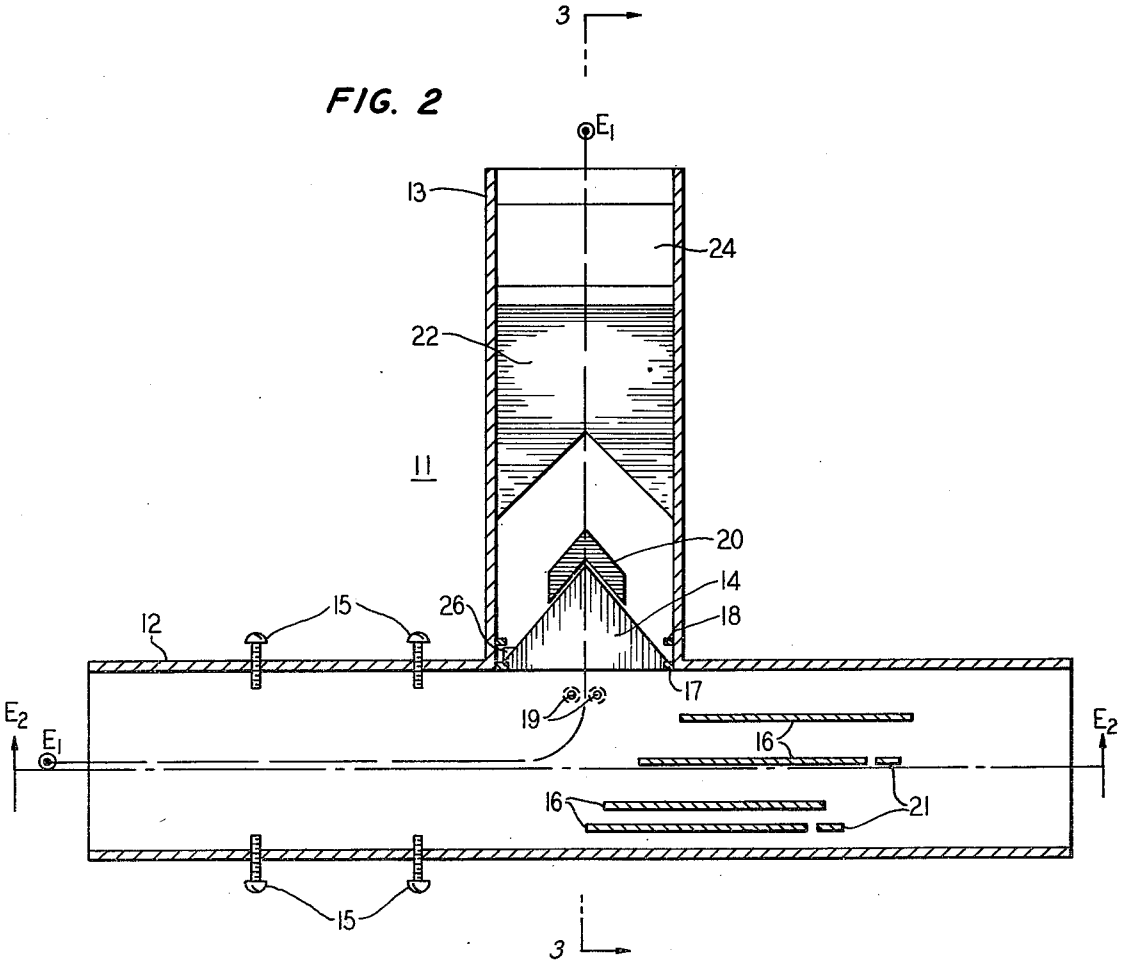
FIG. 2 is a cross-sectional side view of the polarization coupler of FIG. 1 taken through the plane of the longitudinal axis of the main waveguide.

Since the septa 16 divide guide 12 into sections which are beyond cutoff for the $E_1$ polarization, they behave as short circuits and reflect all the energy of this polarization. Due to the staircase-like configuration of septa 16 in the areas of first iris 17, the reflected energy is diverted upward toward guide 13 in much the same manner as an obliquely positioned reflecting mirror reflects incident wave energy. In FIGS. 1 and 2, each of septa 16 are shown having the same length to provide a reverse staircase configuration at the ends away from first iris 17. Spurious resonances, however, will be induced as a set of four resonances in the straight-through return loss at 4 GHz after septa 16 are positioned in main waveguide 12. These resonances are due to dominant modes with opposite polarizations on opposite sides of some of the septa plates 16. In particular, if each of the septa are, for example, 2.425 inches long, one of the resonances corresponds to the length of each of the four septa 16 (2.425 inches $\approx \lambda_g/2$ at 4.023 GHz), another to the horizontal end-to-end length of the two lower septa, e.g., 2,613 inches $\approx \lambda_g/2$ at 3.965 GHz, a third to the overlap length(s) of the septa above and below the center septum, e.g., 1.984 inches and 2.034 inches, respectively, $\approx \lambda_g/2$ at 4.47 GHz, and the fourth to the horizontal end-to-end length of the top and bottom septa, e.g., 3.445 inches $\approx \lambda_g/2$ at 3.66 GHz.

All four of these resonances can be damped by placing thin resistance cards 21 adjacent to, and in line with, the right hand ends, as shown in FIGS. 1 and 2, of the bottom and center septa. The cards 21 are the same width as the septa 16 and extend, for example, 0.25 inches along the guide 12. Resistance cards 21 can be formed of any suitable material such as, for example, a substrate of mica and a metallic film disposed thereon having a desired resistivity, which for purposes of illustration could be 236 ohms/square.

Alternatively, the resistance cards 21 can be eliminated by shortening the septa 16 such that their ends opposite the staircase configuration at the junction of guides 12 and 13 lie in a plane substantially perpendicular to the longitudinal axis of guide 12. By appropriately shortening the septa 16 in this manner, the various resonances indicated hereinabove can be moved outside of the desired operating bandwidth.

Four symmetrically spaced screws 15 are shown in FIG. 1, two of which penetrate the top wall of guide 12 and the other two of which penetrate the bottom wall of guide 12, all of screws 15 being aligned with the longitudinal axis of guide 12 upstream of the junction with side-arm waveguide 13. Screws 15 are not necessary to the proper operation of the present wideband polarization coupler 11, but when used provide an improved impedance match to the $E_2$ polarization.

Figure 3:
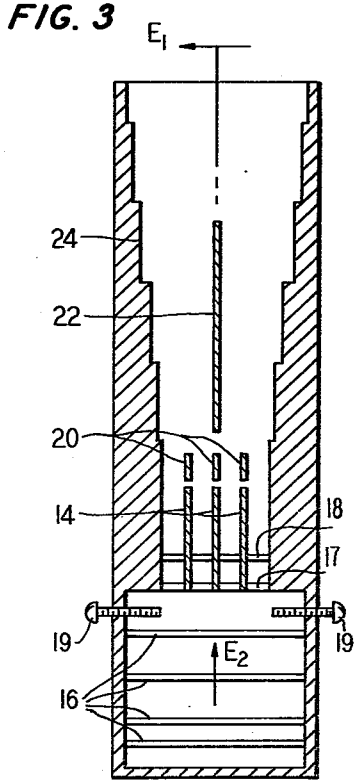
FIG. 3 is a cross-sectional front view of the polarization coupler of FIG. 1 taken through the plane of the longitudinal axis of the side-arm waveguide.

It is important to note that the E-plane dimension of the side-arm waveguide 13 must be uniform for proper operation of the triangular and chevron plates 14 and 20. Consequently, a quarter-wave step-transformer 24 is shown in FIGS. 1 and 3 located a short distance above the chevron plates 20. Conversely, the operation of the plates is not affected by changes in the H-plane dimension, and therefore, symmetrical inductive irises 17 and 18 are used at and near the coupling aperture. Step-transformer 24, however, can be disposed further from the junction of guides 12 and 13 than indicated in FIGS. 1 and 3. More particularly, where a bend in side-arm waveguide 13 is desired after single septum 22, such bend is accomplished more easily with a rectangular guide comparable in size to that surrounding adjacent triangular plates 14. Step-transformer 24 can then be inserted in guide 13 after the bend to achieve the ultimate square configuration for guide 13.

In designing the step-transformer 24, the E-plane dimensions can be determined by, for example, interpolating tables in the article "Tables for Cascaded Homogeneous Quarter-Wave Transformers" by L. Young in *IRE Transactions on Microwave Theory and Techniques* (*PGMTT*), April 1959 at pp. 233–237, the section lengths can be corrected for step capacitances using the method described in "Optimum Design of Stepped Transmission-Line Transformers" by S. B. Cohen in *PGMTT*, April 1955 at pp. 16–21, and the step capacitances calculated from the curve given by N. Marcuvitz in "Waveguide Handbook", *Radiation Laboratory Series*, Vol. 10, McGraw-Hill 1951, at page 309. Therefore, to achieve an improved return loss, e.g., 26 dB or better, in the around-the-corner path from guide 12 to guide 13, the following five principal components are used: (1) a symmetrical inductive first iris 17 at the coupling aperture which reduces the shunt capacitances due to the step in the E-plane dimension of the waveguide, (2) a symmetrical inductive second iris 18 mounted, for example, 0.3 inches above the aperture, (3) four capacitive tuning screws 19 mounted, for example, about 0.28 inches below the aperture, where opposing screws are inserted equally, (4) a staircase of four septa 16 in main waveguide 12, and (5) an equal-ripple (Tchebycheff-type) four-section quarter-wave transformer 24 disposed in side-arm waveguide 13.

The present polarization coupler configuration is capable of supporting certain spurious resonances, but such resonances can be easily damped by adding resistance cards as was explained hereinbefore by using resistance cards 21, or appropriately moved outside the exemplary 4 and 6 GHz bands by making minor dimensional changes as was explained hereinbefore by shortening septa 16. The preferred solution is to move the resonances, because then the insertion loss can be as low as possible, and there is no question about an increase in system temperature if the coupler is part of a low noise receiver, and no question about a reduction in power handling capability if the coupler is part of a high power transmission system. However, since the addition of a card, or cards, is easy, and the corresponding increase in insertion loss is hard to measure in a typical measuring set, it is important to realize that the penalty for the card solution, although small, can be significant.

Another type of spurious resonance appears in the straight-through return loss in the 4 GHz band, and is due to oppositely-polarized dominant-mode waves which are trapped and resonated on opposite sides of the single septum 22 in the side-arm waveguide 13. The trapped mode is probably driven by the oppositely polarized waves on the surfaces of the center one of the triangular plate 14, even though the waveguide in-between is beyond the cutoff for all higher order modes. This spurious resonance, however, can be easily moved above the exemplary 4 GHz band by appropriately decreasing the overall length of single septum 22.

Figure 4:
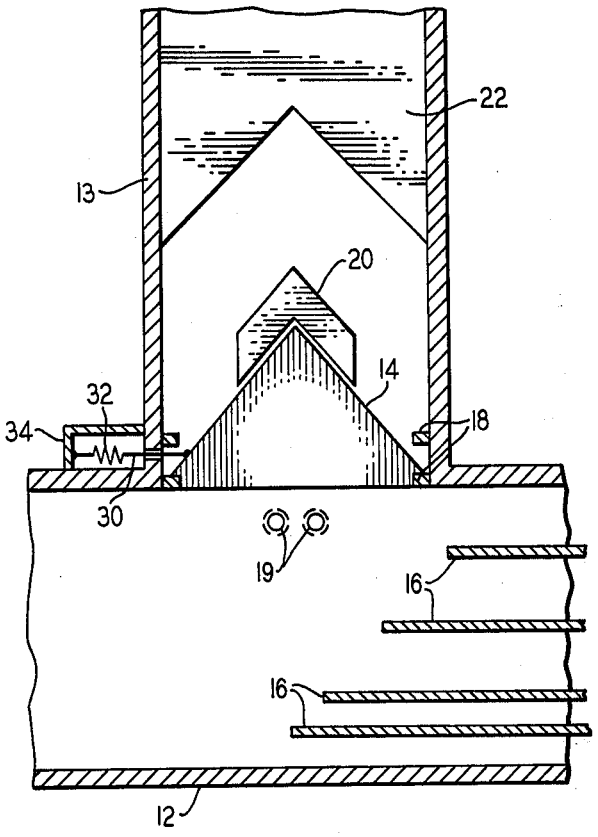
FIG. 4 is a cross-sectional side view of the junction area between the main and side-arm waveguides of the present polarization coupler of FIG. 1.

Still another type of high-Q spurious resonance appears in the around-the-corner return loss in the 6 GHz band, and is caused by energy trapped by the two outside ones of the triangular plates 14 which energies are coupled together. Referring to FIG. 2, the energy flows back and forth between the lower left and lower right hand corners of the affected triangular plates 14, via a path which passes about halfway between the base and peak of the triangular plates 14. At resonance, the length of the path is one free-space wavelength; and since each end is shorted by connection to the waveguide 13 walls, the associated E-fields are zero at the ends and the center of the path, and are a maximum near the $\frac{1}{4}$ and $\frac{3}{4}$ points along the path. The E-fields extend from the surfaces of the front and back triangular plates 14 to the adjacent waveguide wall on one side, and to a virtual ground plane at the center of the side-arm waveguide 13, on the other, i.e., as in a stripline. Viewing the resonant path as a stripline of variable width and taking into account an increase in characteristic impedance toward the ends of the path, the E-field maxima are not at the $\frac{1}{4}$ and $\frac{3}{4}$ points, but are somewhat further out, near the $\frac{1}{8}$ and $\frac{7}{8}$ points, respectively. As in a stripline, fringing effects cause E-field components at the edges of the triangular plates 14 to be parallel to the plate surfaces. Accordingly, this higher order mode can be damped without seriously affecting the main $E_1$ polarization by placing a thin resistance card 26, oriented perpendicular to $E_1$, about $\frac{1}{8}$ of the way up the inclined edge of the front or back triangular plate. Alternatively, resistance card 26 can be replaced by a wire 30 terminating in the area of resistance card 26 which leads to a large resistor 32 mounted outside of side-arm waveguide 13 within a shield 34, as shown in FIG. 4, when the currents that are generated would be too large for handling by a resistance card arrangement. More particularly, a resistance card may only be able to handle one watt of power before the metallization on the mica substrate melts, and where the expected power may by above one watt it would be advantageous to mount a higher power resistor external to side-arm waveguide 13.

It is to be understood that the above-described embodiments are simply illustrative of the principles of the invention. Various other modifications and changes may be made by those skilled in the art which will embody the principles of the invention and fall within the spirit and scope thereof.

I claim:

1. A wideband polarization coupler comprising a first conductively bounded square waveguide section (12) capable of supporting electromagnetic wave energy comprising first and second E-field components which are polarized in a first and a second direction, respectively, orthogonal to each other in a first and a second frequency band;

a second conductively bounded rectangular waveguide section (13) forming a junction with a sidewall of said first waveguide section and oriented to support the E-field components in the first polarization direction ($E_1$) in the first and second frequency bands;

a plurality of thin elongated first septa (16) disposed in said first waveguide section at the junction of said first and second waveguide sections in planes parallel to said first polarization direction, said septa being disposed such that successive septa overlap each other to form a staircase-like arrangement which is capable of reflecting said E-field components in said first polarization direction ($E_1$) toward said second waveguide section;

a symmetrical first iris (17) disposed at said junction of the first and second waveguide sections in a plane parallel to said first direction of polarization capable of introducing a shunt reactance to said reflected electromagnetic wave energy in the first polarization direction; and an odd plurality of triangular-shaped conductive vanes (14) disposed in the second waveguide section at the junction of the two waveguide sections in planes that are parallel to the second polarization direction ($E_2$) and in such proximity to the E-field in said second polarization direction that said vanes are capable of completing the wall current path across said junction for the electromagnetic energy in the second polarization direction, said triangular-shaped vanes having a height which is optimized across the first frequency band;

characterized in that the polarization coupler further comprises a symmetrical second iris (18) disposed in said second waveguide section adjacent and parallel to said first iris which is capable of introducing a second shunt reactance to any reflected electromagnetic wave energy in the first polarization direction;

a plurality of tuning screws (19) mounted symmetrically adjacent to said junction through the sidewalls of said first waveguide section capable of introducing a capacitive reactance to said electromagnetic energy which is reflected into said second waveguide section;

an odd plurality of chevron-shaped conductive vanes (20) disposed in spaced-apart alignment with said odd plurality of triangular-shaped conductive vanes in said second waveguide section, said combination of triangular-shaped vanes and spaced-apart chevron-shaped vanes having a height which is optimized across the second frequency band; and a single second septum (22) disposed in said second waveguide section in a spaced-apart alignment with the center one of the odd plurality of triangular-shaped and chevron-shaped vanes, said second septum having a longitudinal dimension capable of reflecting a fringing field of the E-field components in said second polarization direction and second frequency band back toward said junction which may not have been reflected by said chevron-shaped vanes.

2. A wideband polarization coupler in accordance with claim 1 characterized in that the wideband polarization coupler further comprises means (26) capable of damping a trapped higher order mode, said damping means being disposed in said second waveguide section in alignment with one of the odd plurality of triangular-shaped vanes which is not the central one of said vanes.

3. A wideband polarization coupler in accordance with claim 2 characterized in that said damping means (26) comprises a resistance card comprising a substrate of insulating material with a layer of electrically conductive material formed on the surface of said substrate.

4. A wideband polarization coupler in accordance with claim 2 characterized in that said damping means (26) comprises a resistance mounted external to said first and second waveguide sections with a conductive lead therefrom passing through the sidewall of said second waveguide section for termination at said one of the triangular-shaped vanes which is not the central one of said vanes.

5. A wideband polarization coupler in accordance with claim 1 wherein each of said plurality of first septa are substantially the same length characterized in that the polarization coupler further comprises:

a first and a second resistance card (21) extending across said first waveguide section comprising a substrate of a nonconductive material and a layer of electrically conductive material disposed on the surface thereof, said first and second resistance cards being disposed in a spaced-apart alignment with a central-one of the first septa and the first septa furthest from said junction, respectively, adjacent to the ends thereof furthest from said junction.

6. A wideband polarization coupler in accordance with claim 1 characterized in that said plurality of thin elongated first septa (16) having their ends furthest from said junction terminated in a plane substantially perpendicular to the longitudinal axis of said first waveguide section, the lengths of said first septa being such that spurious resonances produced by said first septa are outside the first and second frequency bands.

7. A wideband polarization coupler according to claim 1 characterized in that the polarization coupler further comprises:

a symmetrically-shaped quarter-wave step-transformer (24) disposed in an area of the second waveguide section further away from said junction than the plurality of chevron-shaped vanes for converting the rectangular second waveguide section into a square waveguide section.

8. A wideband polarization coupler according to claim 1 characterized in that the polarization coupler further comprises:

a first and a second pair of second tuning screws (15), each pair of second tuning screws being disposed both in alignment with both the longitudinal axis of the first waveguide section and the second polarization direction and through opposing sidewalls of the first waveguide section upstream of said junction.

* * * * *